US005186534A

United States Patent [19]

Woodgate

[11] Patent Number: 5,186,534

[45] Date of Patent: Feb. 16, 1993

[54] LIGHT FITTING

[75] Inventor: Terence A. Woodgate, Bruxelles, Belgium

[73] Assignee: GTE Rotaflex Limited, London, England

[21] Appl. No.: 743,419

[22] PCT Filed: Mar. 7, 1990

[86] PCT No.: PCT/GB90/00346

§ 371 Date: Aug. 22, 1991

§ 102(e) Date: Aug. 22, 1991

[87] PCT Pub. No.: WO90/11470

PCT Pub. Date: Oct. 4, 1990

[30] Foreign Application Priority Data

Mar. 23, 1989 [GB] United Kingdom ..... 8906738

[51] Int. Cl.[5] ..... F21M 3/00

[52] U.S. Cl. ..... 362/419; 362/66; 362/427; 362/430

[58] Field of Search ..... 362/66, 285, 287, 418, 362/419, 425, 428, 427, 430

[56] References Cited

U.S. PATENT DOCUMENTS

| | | | |
|---|---|---|---|
| 3,761,890 | 9/1973 | Fritts et al. | 362/66 |
| 4,115,841 | 9/1978 | Alexander | 362/66 |
| 4,259,660 | 3/1981 | Oliver | 362/66 |
| 4,516,190 | 5/1985 | Kloots | 362/285 |
| 5,034,860 | 7/1991 | Bryant et al. | 362/66 |

FOREIGN PATENT DOCUMENTS

| | | | |
|---|---|---|---|
| 2918532 | 11/1980 | Fed. Rep. of Germany | 362/428 |

*Primary Examiner*—Ira S. Lazarus
*Assistant Examiner*—Y. Quach
*Attorney, Agent, or Firm*—Watson, Cole, Grindle & Watson

[57] ABSTRACT

A light fitting is adjustable to vary the beam direction and for this purpose comprises a rotatable support stem carrying a lamp housing to permit rotation of the lamp housing about a pivot axis inclined at 45° to the stem axis and to the central axis of the lamp housing. A handle fastened with the lamp housing and on the side of the stem remote therefrom can be manipulated to turn the lamp housing and stem around the stem axis to rotate the lamp housing about the pivot axis.

11 Claims, 1 Drawing Sheet

LIGHT FITTING

BACKGROUND OF THE INVENTION

This invention relates to light fittings, and is concerned in particular with a light fitting having a support arrangement enabling the direction of the light beam emitted by the fitting to be adjusted.

Various support arrangements have been proposed in the past in which a lamp housing enclosing the bulb holder can be rotated independently about a first axis perpendicular to a central axis of the housing, and about a second axis inclined at 45° to the first and central axes. This geometrical arrangement allows the beam axis, which is along the central axis, to be adjusted to project in any direction to one side of a plane perpendicular to the first axis. Such light fittings are described for example in our earlier patent specifications GB1581928 and GB1474186. Another know fitting is disclosed in specification FR2286343 and comprises a housing journalled on a support stem for rotation about an axis at 45° to the respective axes of the stem and housing. The stem is equipped with a radially projecting handle for rotating the stem, but to rotate the housing about the 45° axis it must be grasped in the hand, which is a disadvantage because it will get hot due to the heat from the bulb. A further disadvantage is that continuous rotation about the 45° axis is prevented by a stop, provided to prevent the electric wires becoming twisted, which can be electrically dangerous when adjusting the beam direction.

SUMMARY OF THE INVENTION

In accordance with the present invention there is provided an electric light fitting comprising a lamp housing enclosing a bulb holder and having a central axis, projection means extending from the housing along a pivot axis inclined to said central axis, support means having a rotation axis inclined to said pivot axis, the support means carrying mounting means thereon, said projection means being coupled to the mounting means for rotation relative thereto about the pivot axis, and said projection means extending beyond the mounting means to provide a handle for turning the housing about the pivot axis and for turning the housing and support means about the support rotation axis. With a light fitting embodying the invention a single handle located at a relatively remote position from the bulb holder provides especially simple and convenient adjustment of the housing and hence beam direction about the two adjustment axes, whereby such adjustment operations are greatly facilitated. The pivot axis preferably lies at 45° to the central and support axes, in which case the central axis can be adjusted through 90° from a position parallel to the support axis to a position perpendicular to the support axis by rotating the handle. If other ranges of adjustment are required different angles of inclination may be selected.

In a preferred construction the mounting means is tubular and the projecting means passes therethrough. In addition the support means comprises a contact adapted to rest against a contact located within the projection means and having an annular surface extending around the pivot axis. This arrangement allows the housing to be made continuously rotatable about the pivot axis because wires which would become twisted can be obviated.

BRIEF DESCRIPTION OF THE INVENTION

To assist a better understanding of the invention an exemplary embodiment will now be described in more detail with reference being made to the accompanying drawings in which:

FIG. 1 is a schematic cross-sectional view of a light fitting embodying the invention; and FIG. 2 is a more-detailed scrap section showing the connection between the lamp housing and support stem.

DETAILED DESCRIPTION OF THE INVENTION

Figure 1:
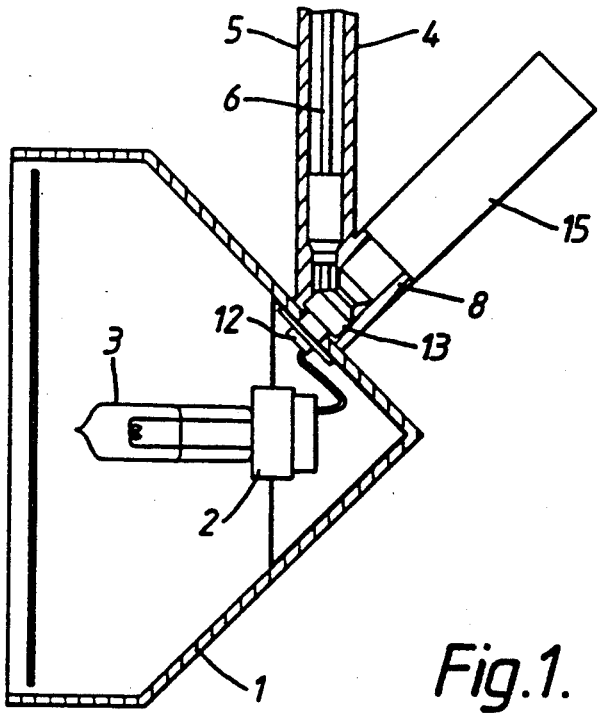
Figure 2:
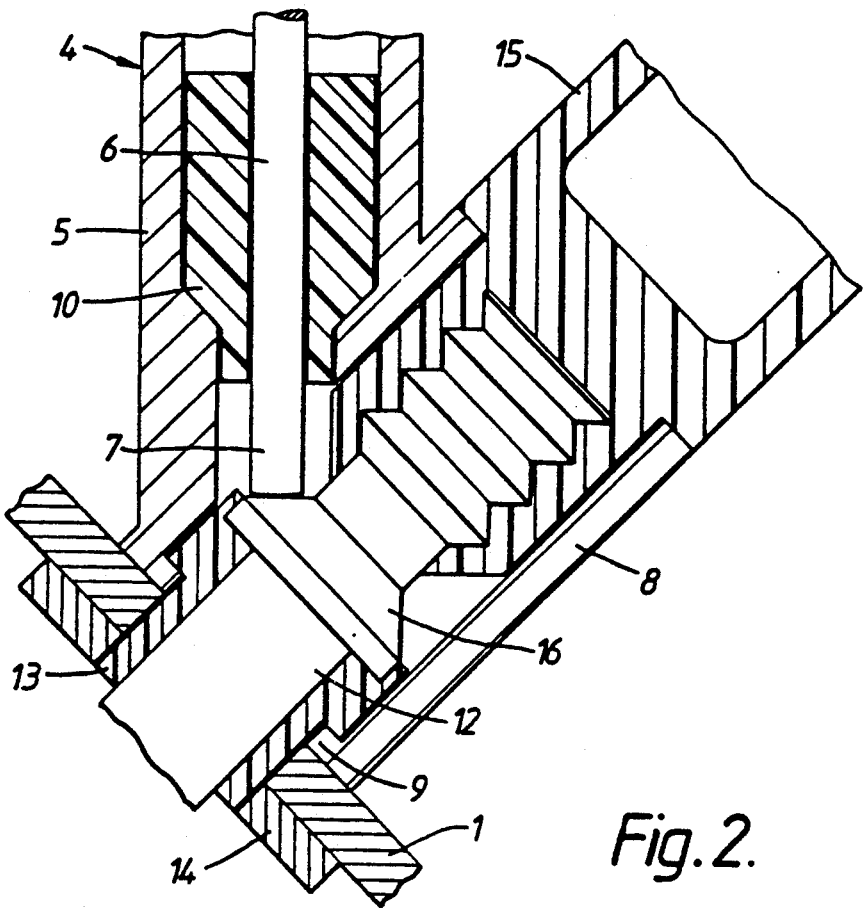

The light fitting illustrated in the drawing comprises a lamp housing 1 having a cylindrical forward end portion and a conical rear end portion with an apex angle of 90°. Mounted in the housing is a bulb holder 2 positioned to support a low voltage bulb 3 on the central axis of the housing for the fitting to project a beam of light centered on said central axis. The housing is carried on a support stem 4 which is shown extending vertically downwards e.g. from an upper support structure (not shown). The stem comprises a tubular metal casing 5 on the axis of which is located a central conductor 6. Fixed to the lower end of the casing is a cylindrical sleeve 8 having its axis inclined at 45° to the axis of the support stem. The end of the sleeve nearest the housing 1 has an inturned flange 9 and defines one contact for the supply of electric current to the bulb holder, this contact being arranged to abut directly the housing which is electrically conductive and connected electrically by any convenient means to one terminal of the bulb holder. A second contact has the form of a pin 7 and is defined by an end portion of the conductor 6 projecting through an insulating spacer 10 supporting the conductor axially and in spaced relationship to the casing 5. The contact pin cooperates with a contact member 12 extending coaxially through the sleeve 8 from within the housing 1. The inner end of the member 12 is connected electrically to the second terminal of the bulb holder, such as by means of a length of wire. An insulating sleeve 13 surrounds the member 12 over the lengthwise portion extending through the opening in the housing conical wall and the adjacent end portion of sleeve 8, an external shoulder on the insulating sleeve engaging the flange 9 and a retaining element 14 being fitted onto the inner end of the sleeve 13 within the housing 1 to secure it to the housing. From the foregoing it will be understood that the axis of member 12 is inclined at 45° to the central axis of the lamp housing and to the axis of the support stem 4. The outer end of the member 12 is screw threaded and screwed onto this end of the member is a handle 15 of insulating material, e.g. formed as a plastics moulding. The outer surface of the handle is stepped so that it forms a smooth continuation of the outer surface of the mounting sleeve 8. It will be seen that the inner end of the handle helps to journal the member 12 within sleeve 8. Between the handle 15 and the insulating sleeve 13, the member 12 has a flange 16 with a conical surface defining an annular contact face against which the pin 7 rests and which at the position of contact with the pin lies substantially perpendicular to the axis of the support stem.

The support stem preferably comprises a spring for pressing the pin 7 into firm contact with the conical contact face of the flange 16. In addition, the support stem will be adapted, either by incorporation therein of a rotating coupling or by suitable connection thereof to a supporting member, to permit rotation of the mounting sleeve 8 about the stem axis.

In one preferred construction the stem may incorporate a rotation coupling of a form generally as shown in FIG. 6 of International Patent Application PCT/GB89/00665 (Publication No. 89/12918) the contents of which are incorporated herein by this reference. In such a case the tubular casing 5 may be integral with one part of the split housing of the coupling and the contact pin 7 may be constituted by the corresponding pin contact of the coupling. With a stem of this construction it will comprise an upper end part which may be rotationally fixed, e.g. to a distribution track by means of an electrical coupling as also described in the aforementioned International Patent Application No. PCT/GB89/00665, and a lower end part which can be continuously rotated relative to the upper part.

Whatever arrangement is chosen to enable rotation about the stem axis, adjustment of the lamp housing about this axis may be achieved by manipulation of the handle 15. Furthermore, by rotating the handle about the pivot axis defined by sleeve 8, the inclination of the housing to the stem axis is adjustable. Thus adjustment about both axes can be performed simultaneously merely by holding the handle. In addition because the handle is remote from the bulb and of material having low heat conductivity it will not get too hot to be held comfortably, whereby adjustment of the beam direction is further facilitated. Yet another advantage is gained by enabling continuous rotation about both axes of adjustment since it is no longer possible to turn the housing in the wrong direction to achieve the desired beam direction.

I claim:

1. A light fitting comprising a lamp housing (1) having a central axis, a bulb holder (2) mounted in the lamp housing for supporting a light bulb having a predetermined beam direction, and a support (4) having mounting means (8) coupled to the lamp housing to enable rotation of the lamp housing relative to the support about a pivot axis inclined to said central axis, the support defining a rotation axis inclined to the pivot axis, wherein the light fitting includes means projecting from the lamp housing along the pivot axis and beyond the mounting means to provide a handle (15) for turning the lamp housing about the pivot axis and about the rotation axis for adjusting the beam direction.

2. A light fitting according to claim 1, wherein the pivot axis is at an angle of substantially 45° to the central axis and to said rotation axis.

3. A light fitting according to claim 1 wherein the mounting means comprises a sleeve member (8), and said projecting means extends through the sleeve member and couples the lamp housing (1) to the support (4).

4. A light fitting according to claim 1 wherein the lamp housing (1) is continuously rotatable about the pivot axis.

5. A light fitting according to claim 4, wherein the projecting means includes an electric contact (16) having an annular surface extending about the pivot axis, and the support (4) includes a contact element (7) resting against said annular surface

6. A light fitting according to claim 5, wherein the contact element (7) extends along the rotation axis and said annular surface (16) is substantially perpendicular to the rotation axis at a surface of contact with said contact element.

7. A light fitting according to claim 5 wherein the contact surface is defined on a contact member (12) extending from the lamp housing.

8. A light fitting according to claim 7, wherein the handle (15) is fastened to the contact member (12).

9. A light fitting according to any one of claims 1 to 8, wherein the handle (15) is of heat insulating material.

10. A light fitting according to any one of claims 1 to 9, wherein the support includes a rotation coupling enabling continuous rotation of the lamp housing about said rotation axis.

11. A light fitting according to any one of claims 1 to 10, wherein the mounting means (8) contacts said lamp housing (1) around said pivot axis to provide an electrical connection to the bulb holder.

* * * * *